US006119497A

United States Patent [19]

Eisele

[11] Patent Number: 6,119,497

[45] Date of Patent: Sep. 19, 2000

[54] METHOD FOR USE WITH A LATHE FOR FORMING A JOURNAL ON METAL STOCK

[75] Inventor: Ronald R. Eisele, Colorado Springs, Colo.

[73] Assignee: Minco Manufacturing, Inc., Colorado Springs, Colo.

[21] Appl. No.: 09/058,463

[22] Filed: Apr. 10, 1998

[51] Int. Cl.[7] ..... B21D 22/14

[52] U.S. Cl. ..... 72/84; 72/370.25

[58] Field of Search ..... 72/68, 80, 81, 72/83, 84, 85, 370.25

[56] References Cited

U.S. PATENT DOCUMENTS

| | | | |
|---|---|---|---|
| 596,675 | 1/1898 | Collin | 72/81 |
| 1,270,402 | 6/1918 | Fulton | 72/102 |
| 1,499,534 | 7/1924 | Katzenmeyer . | |
| 1,671,994 | 6/1928 | Nelson | 72/83 |
| 2,022,797 | 12/1935 | Wyer | 72/85 |
| 2,265,723 | 12/1941 | Dewey et al. | 113/53 |
| 2,524,420 | 10/1950 | Blampin | 113/52 |
| 2,645,953 | 7/1953 | Schlitters | 72/108 |
| 2,686,489 | 8/1954 | Kaestner | 113/52 |
| 3,029,764 | 4/1962 | Sporck | 72/85 |
| 3,247,591 | 4/1966 | Panseri | 29/474.3 |
| 3,255,518 | 6/1966 | Golata | 29/159.1 |
| 3,517,534 | 6/1970 | Werner et al. | 72/83 |
| 3,874,208 | 4/1975 | Werner | 72/84 |
| 3,956,914 | 5/1976 | Prochaska | 72/80 |
| 4,178,785 | 12/1979 | Tuschy et al. | 72/78 |
| 4,579,289 | 4/1986 | Siebke | 241/110 |
| 4,693,105 | 9/1987 | Lee, Jr. | 82/84 |
| 4,766,752 | 8/1988 | Gronert et al. | 72/84 |
| 5,465,598 | 11/1995 | Hirai et al. | 72/84 |

*Primary Examiner*—Lowell A. Larson

*Attorney, Agent, or Firm*—LeBoeuf, Lamb, Greene, MacRae, L.L.P.; John R. Posthumus, Esq.

[57] ABSTRACT

A forming tool in accordance with the present invention is provided which includes a forming wheel, a shaft, a tool holder, bearings, washers, locking plate, locking bolt, and nut. The forming tool is for use with a lathe to form a journal on the ends of extruded tubing consisting of a variety of materials having various wall thicknesses. The forming operation in accordance with the present invention occurs when the lathe's turret moves the forming tool to cause the forming wheel to contact a portion of the extruded tube, which is rotated by the lathe's spindle. As a result of the contact, metal material is displaced on the extruded tube, and a journal is formed on the extruded tube. In accordance with one aspect, the forming tool is returned to its starting position by contacting a portion of the extruded tube as the forming wheel is moved away from the spindle of the lathe. In accordance with another aspect, the forming wheel includes a forming edge, which is the portion of the forming wheel that contacts the extruded tube when the forming operation occurs. The forming edge extends a length $L_E$ from the body of the forming wheel to allow the forming wheel to contact the extruded tube when the forming wheel is moved in the direction away from the spindle of the lathe. The forming edge includes a radius which is varied in accordance with the amount of material desired to be displaced on the extruded tube, and/or the desired shape of the transition edge between the outer diameters of the journal and unprocessed portion of the extruded tube. When used with a lathe having a turret which is capable of moving the forming tool in a variety of directions, the forming tool can form a variety of contours on the outer surface of the journal, including straight lines, angled lines, arcs and radiuses.

17 Claims, 16 Drawing Sheets

METHOD FOR USE WITH A LATHE FOR FORMING A JOURNAL ON METAL STOCK

FIELD OF THE INVENTION

The present invention generally relates to the field of machine tooling of metal stock. The present invention relates particularly to forming journals on extruded tubes.

BACKGROUND OF THE INVENTION

Creating journals on metal stock by the use of a manufacturing process known as forming is advantageous in comparison to other known manufacturing processes because less material is wasted and, in the circumstance where the metal stock is rotated during the forming process, the metal stock is exposed to less stress. Typically, forming includes two types of processes, compression forming and flow forming. Referencing FIG. 1A, compression forming involves using a combination of compression and tension to form a finished part 10 from a sheet metal disc 12, wherein the wall thickness $S_1$ of the finished part 10 is the same as the wall thickness $S_0$ of the sheet metal disc 12. Flow forming involves two different types of processes, shear forming and cylindrical flow forming. Referencing FIG. 1B, shear forming involves forming a finished part 14 from a sheet metal disc 16, where the wall thickness $S_1$ of a portion of the finished part 14 changes and the wall thickness $S_0$ of a portion of the finished part 14 stays the same as the wall thickness $S_0$ of the sheet metal disc 16. Referencing FIG. 1C, cylindrical flow forming involves forming a journaled end 18 from an extruded tube 20, such as for example a tube 22 or a cup 24, which can be parallel-sided, tapered or radiused, wherein the ending inner diameter $d_I$ of the journaled end 18 is less than the starting inner diameter $D_I$, and the ending wall thickness $S_1$ of the journaled end 18 is less than the starting wall thickness $S_0$.

Known methods for forming a journal on extruded tubes are limited. The use of said methods requires the use of special forming machinery which can be very expensive to acquire, and often require special ordering to meet the specific needs of the operator. Moreover, using forming machinery to form a journaled end on extruded tubing generally requires an operator to be specially trained in the operation of the machinery, and once trained, requires the operator to properly position an extruded tube within the forming machine, instruct the forming machine to undertake the forming operation, and remove the extruded tube from the forming machine after completing the forming operation. The forming operation usually takes place in an area of the machine which is not enclosed, and therefore the forming machine does not lend itself to the use of flood coolant during the forming operation. Following removal, additional manufacturing steps are necessary to finish the formed journaled end because the forming process usually results in a journaled end having an imprecise outer diameter. As a result, the formed journaled end usually undergoes additional processing, such as for example using a lathe to cut material away from the formed journaled end, to obtain a finished journaled end having a precise outer diameter.

A metal machining lathe, in contrast to special forming machinery, is relatively inexpensive and commonly used machine to process metal stock into finished parts. In this regard, a lathe can be used to create a journal on an extruded tube by cutting material away from the end of the extruded tube. The cutting operation usually takes place in an area of the lathe which is enclosed, and therefore the lathe lends itself to the use of flood coolant during the cutting operation.

Referencing FIGS. 2A and 2B, a lathe can be used to create a journaled end 28 having an outer diameter $D_O$ on an extruded tube 26 having a wall thickness $S_0$ by cutting the material away from the end of the extruded tube 26, thereby causing the extruded journal 26 to have a wall thickness $S_1$ at the journaled end 28. However, the process for creating the journaled end 28 using the lathe as described counters the advantage of using a forming manufacturing process. The lathe cuts away material from the extruded tube 26 to create the journaled end 28, thereby causing waste. Additionally, as can be seen in FIG. 2B, the use of a lathe to create a journaled end requires the extruded tube to have a starting wall thickness that is of a greater starting wall thickness that would otherwise be necessary if the journaled end was formed using a forming process. As a result, the finished part, which includes the extruded tube and journaled end, has more overall mass because the starting inner diameter $d_I$ of the extruded tube 26 is the same as the ending inner diameter $D_I$ of the journaled end 28.

Referencing FIGS. 3A and 3B, the disadvantages of greater wall thickness and additional mass of a finished part which result from solely using a lathe to cut a journaled end on an extruded tube can be overcome by welding an end cap 32 having a journaled end 34 with an inner diameter $D_I$, to a body piece 30 having an inner diameter $d_I$, which is greater than inner diameter $D_I$. In this regard, the end cap 32 can be welded to a body piece 30, and the end cap 32 machined to a precise outer diameter $D_O$ by a lathe. However, this process has other disadvantages. The end cap 32 is an additional part that requires separate and prior manufacturing. Additionally, this process usually requires the use of special machinery, such as a friction welding machine or inertia welding machine, to weld the end cap 32 to the body piece 30. Finally, the use of this process creates additional manufacturing steps after the end cap 32 has been welded to the body piece 30 and prior to using the lathe to finish the journaled end 34 to a precise outer diameter $D_O$. The welding of the end cap 32 to the body piece 30 results in a welding bead which requires removal. After the end cap 32 has been welded the body piece 30, and the welding bead removed, the welded end cap 32 and body piece 30 combination should be stressed relieved by heating the combination to cause the molecular composition of the bond 38 between the end cap 32 and the body piece 30 to be consistent throughout the bond 38.

SUMMARY OF THE INVENTION

It is the object of the present invention to provide a tool for use with a lathe, which allows the lathe to be used to form a journal on an extruded tube.

It is another object of the present invention to minimize the need to acquire and use special forming machinery in order to form a journal on an extruded tube.

It is another object of the present invention to eliminate the manufacturing step of using special forming machinery as part of the process of creating a finished journal on an extruded tube, by using a lathe, as part of a single manufacturing step, to first form a journal having an imprecise diameter and to second cut the journal to a precise diameter.

In accordance with the present invention, a forming tool for use with a lathe is provided. The tool includes a forming wheel, a tool holder and bearings. The bearings connect the tool holder and the forming wheel, and allow the forming wheel to rotate relative to the tool holder. A portion of the tool holder is adaptable to be received by a turret of a lathe. Preferably, the forming wheel is made of hardened heat-treated tool steel.

In accordance with one aspect of the present invention, a method for use with a lathe to form a journal on extruded tubing is provided. The method includes providing the forming tool in accordance with the present invention with a lathe which includes a spindle capable of holding and rotating extruded tubing, and a turret capable of holding a portion of the tool holder of the forming tool. An advantage of the present invention is that the lathe is not required to have a high powered engine. Preferably, the lathe provided in connection with the method of the present invention includes a motor having horse power which is no less than 5 and no greater than 20. The method further includes the step of moving the turret of the lathe to cause the forming wheel of the forming tool to contact the extruded tube rotated by the spindle of the lathe. Preferably, the extruded tube is rotated about a first axis, and the forming wheel is positioned relative to the extruded tube such that the forming wheel rotates about a second axis, substantially parallel to the first axis, when the forming wheel contacts the extruded tube. As a result of the contact, metal material is displaced on the extruded tube, and a journal is formed on the extruded tube.

In accordance with another aspect, the method of the present invention includes the step of providing a cutting tool which comprises a shank, and a cutting surface which is fixedly attached to the shank. The method further includes the step of moving the turret to cause the cutting surface of the cutting tool to contact the formed journal rotated by the spindle of the lathe. As a result, metal material is removed from the formed journaled end of the extruded tube, and the journal is finished to a precise diameter. Preferably, the steps of forming and cutting the journaled end of the extruded tube occur as part of the same manufacturing operation, i.e., the journal is first formed on the extruded tube and next cut to a precise diameter, without removing the extruded tube from the spindle between the steps of forming and cutting the journaled end. Preferably, the lathe includes an index turret capable of holding multiple tools for forming or cutting extruded tubing. More preferably, the lathe includes an index turret which is rotatable to move the desired tool, forming or cutting tool, into proper position, before moving the turret to cause the desired tool to contact the rotating extruded tube.

In accordance with the method of the present invention, it is preferable to provide a lathe having expanded capabilities. In accordance with another aspect, the method of the present invention includes providing a lathe having a turret which is capable of moving the forming tool in a variety of directions, for example linear and circular interpolation, relative to the extruded tube rotated by the spindle of the lathe. As a result, a variety of contours for the outer surface of the journal are possible, including straight lines, angled lines, arcs and radiuses. In accordance with another aspect, the method of the present invention includes providing a lathe which is programmable to automatically move the turret in accordance with one or more predefined instructions. As a consequence, the movement of the turret to cause the forming tool to contact the extruded tube rotated by the spindle of the lathe occurs automatically in accordance with the predefined instructions. Alternatively, the method of the present invention includes a lathe which is capable of moving the turret by manual operation. Alternatively, the method of the present invention includes providing a lathe which is capable of moving the turret by the use of a hydraulic tracing unit, which is capable of causing the turret to move in accordance with a predetermined template. In this regard, the turret causes the forming tool to contact the extruded tube rotated by the spindle of the lathe and move the turret in accordance with the template being traced by the hydraulic tracing unit.

In accordance with another aspect of the present invention the forming wheel includes a forming edge, which is the portion of the forming wheel which contacts the extruded tube during the forming operation. Preferably, the forming edge extends away from the body of the forming wheel to allow the forming wheel to contact the extruded tube when the forming wheel is moved in the direction which is away from the spindle of the lathe. Preferably, the forming edge includes a radius which is varied in accordance with the amount of material desired to be displaced on the extruded tube, and/or the desired shape of a portion of the journal formed. The radius of the forming edge determines the surface area of the forming edge. For example, a forming edge with a radius of 0.250 inches will have a greater surface area than a forming wheel having a forming edge with a radius of 0.0080 inches. The surface area of the forming edge determines the amount of material which can be displaced during a single pass of a forming tool during the forming operation. For example, a forming wheel having a forming edge with a radius of 0.250 inches is capable of displacing more material on an extruded tube than a forming wheel having a forming edge with a radius of 0.0080 inches. The surface area of the forming edge also determines the shape of the transition edge, which is the area of the journal that transitions from a first portion of the journal having a first contour to a second portion of the journal having a second contour which is different from the first contour. The shape of the transition edge will conform with the radius of the forming wheel. For example, a forming wheel having a forming edge with a radius of 0.250 inches will result in a transition edge that corresponds to a radius of 0.250 inches, and a forming wheel having a forming edge with a radius of 0.0080 inches will result in a transition edge that corresponds to a radius of 0.0080 inches. Thus, depending on the amount of material to be displaced and the desired shape of the transition edge, one or a combination of forming wheels having forming edges with different radiuses can be selected. For example, if the sharper transition edge is desired, a forming tool having a forming wheel having a first radius is selected to make a first pass on the extruded tube to form the journal to the desired outer diameter, and a second forming tool having a second radius which is less than the first radius can be used to form the transition edge of the journal. Preferably, the radius of the forming edge is in the range of no less than 0.0080 inches and no greater than 0.250 inches.

DETAILED DESCRIPTION

The following description is of the best presently contemplated mode of carrying out the invention. This description is made for the purposes of illustrating the general principals of the invention, and is not to be taken in a limiting sense. The scope of the invention is best determined by reference to the appended claims.

Figure 1A:
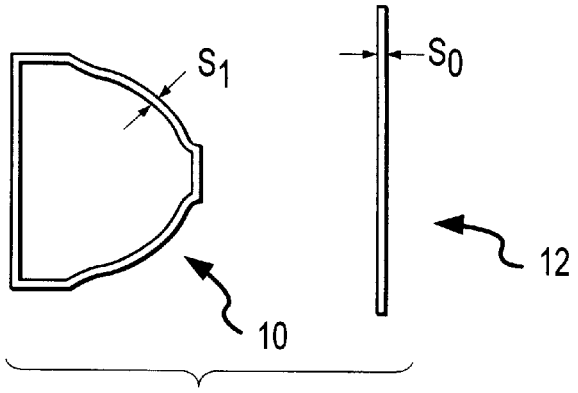
FIGS. 1A, 1B, and 1C show finished parts using known forming manufacturing processes on certain metal stocks.
Figure 1B:
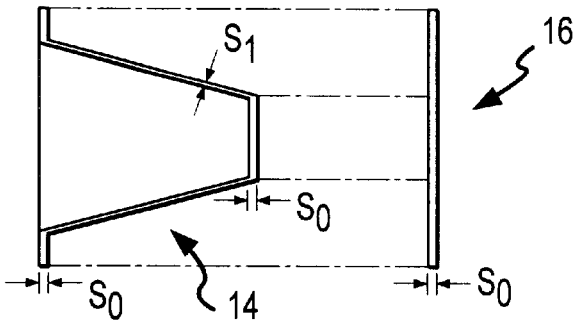
Figure 1C:
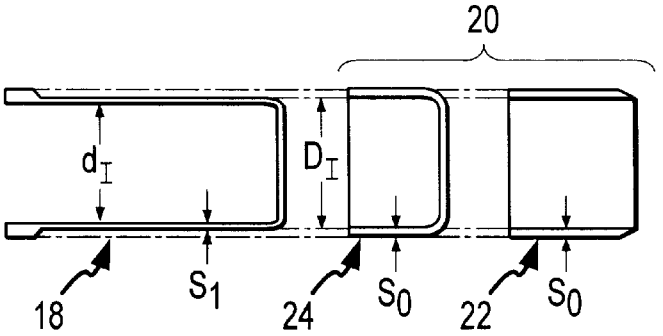
Figure 2A:
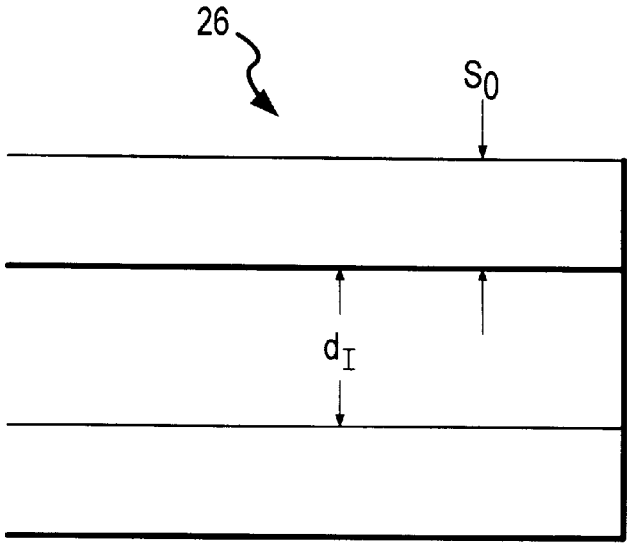
FIG. 2A shows an uncut extruded tube.
Figure 2B:
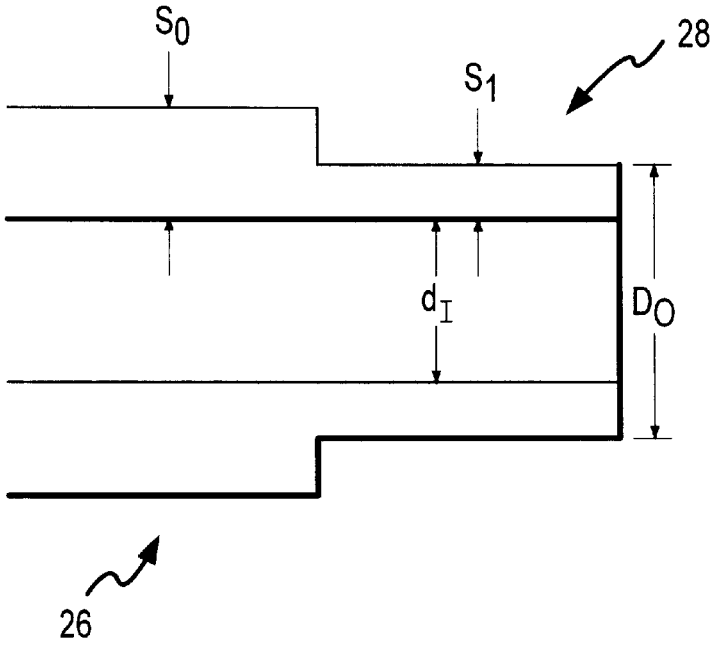
FIG. 2B shows the extruded tube shown in FIG. 2A after a journal has been cut on the extruded tube using a lathe.
Figure 3A:
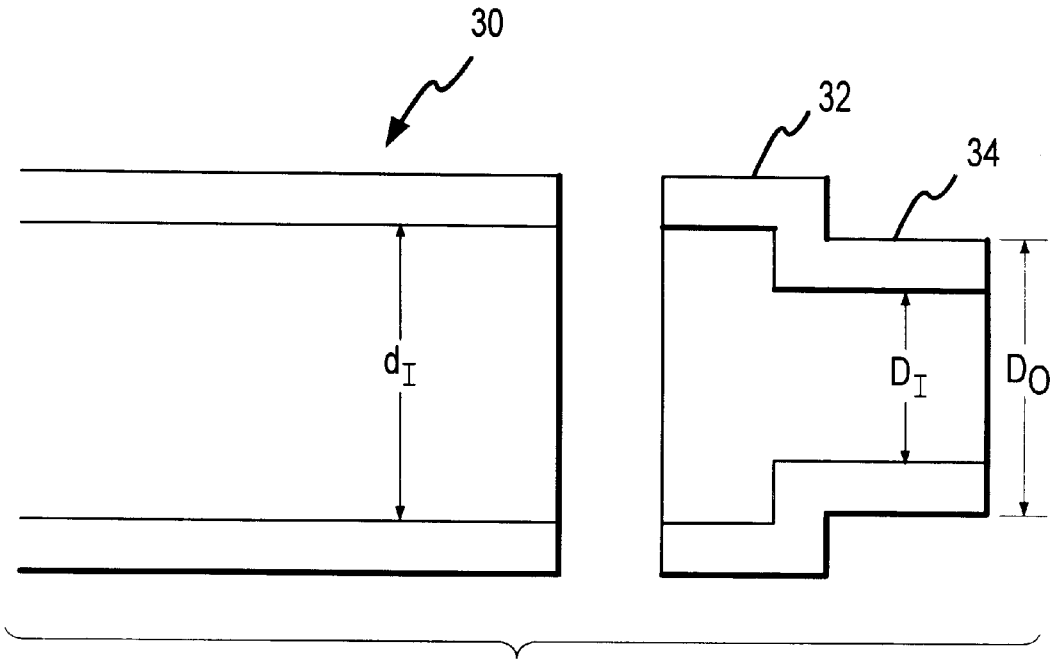
FIG. 3A shows an end cap and extruded tube before welding.
Figure 3B:
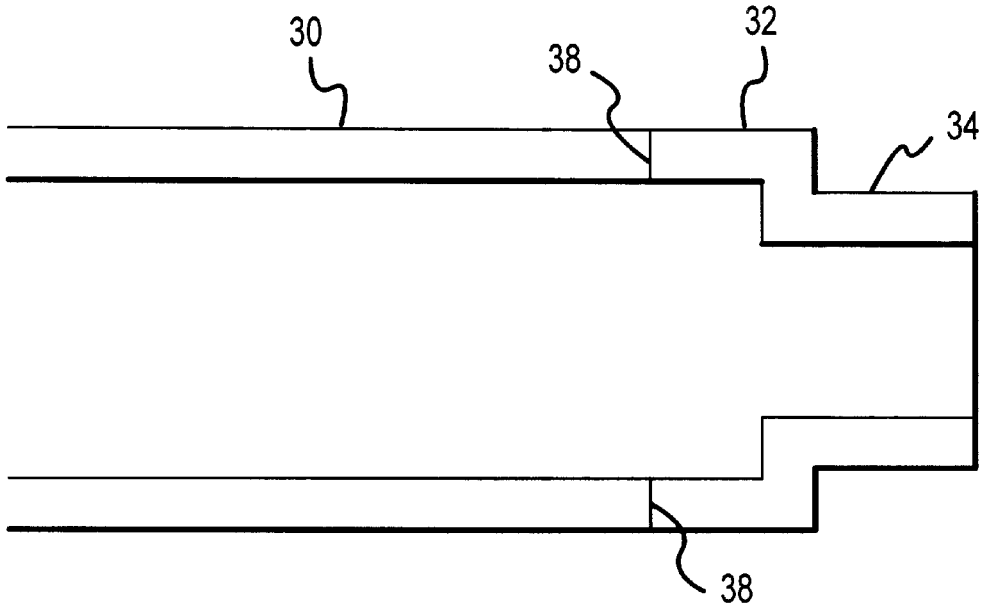
FIG. 3B shows an end cap and extruded tube after welding.
Figure 4:
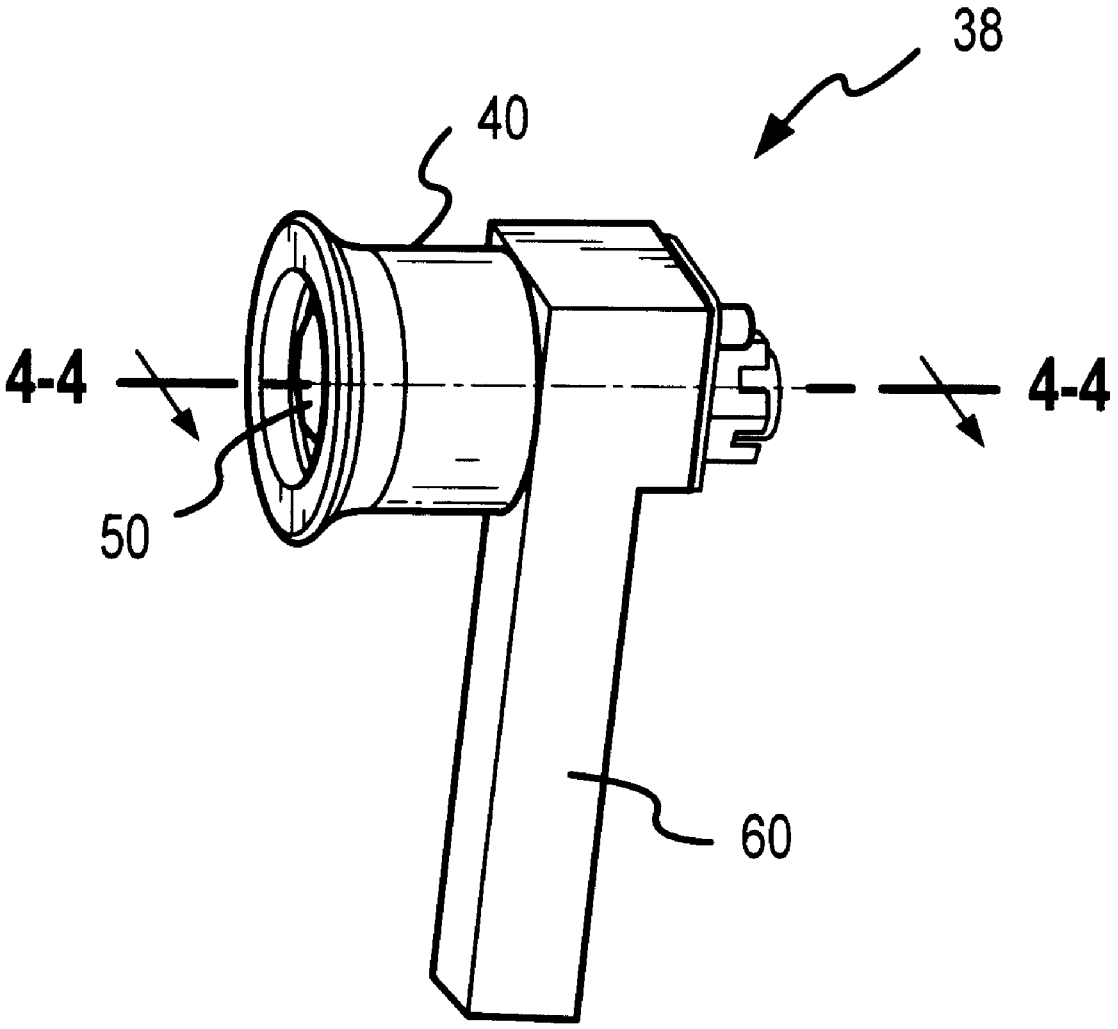
FIG. 4 is perspective view of a tool in accordance with one embodiment of the present invention.
Figure 5:
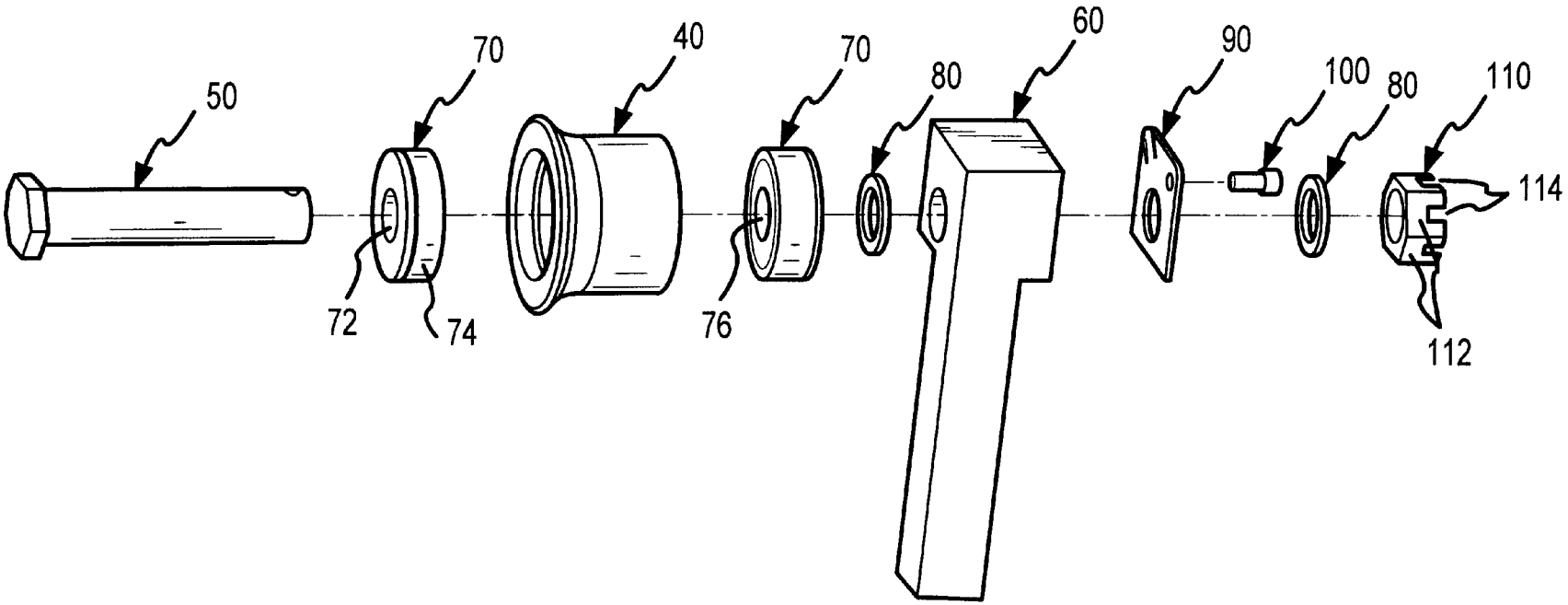
FIG. 5 is exploded perspective view of the tool shown in FIG. 4.
Figure 6:
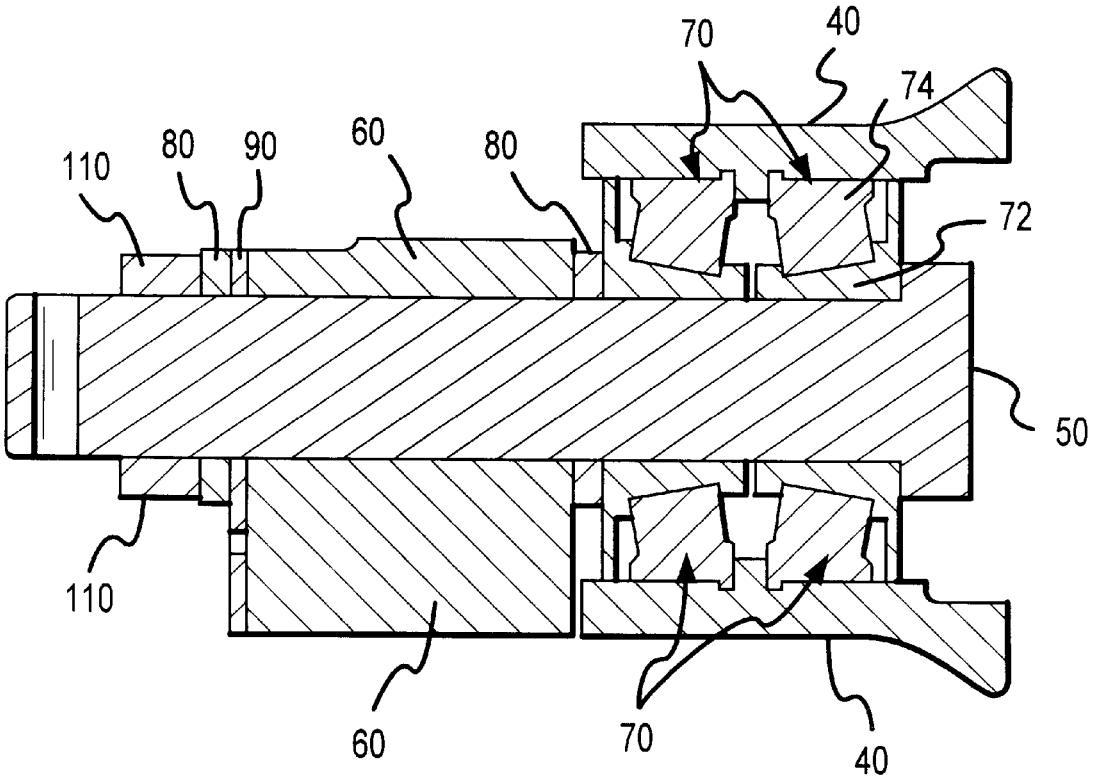
FIG. 6 is a cross section view of the tool shown in FIG. 4 as taken through the plane indicated by 4—4.
Figure 7:
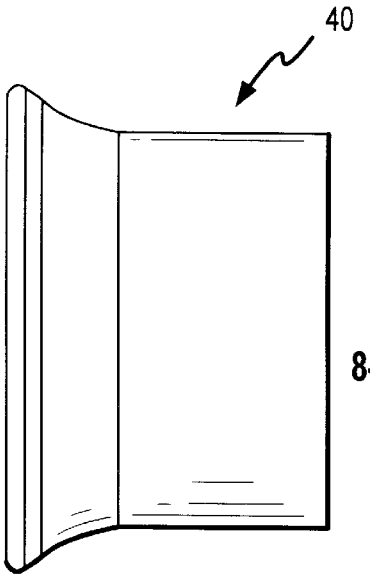
FIG. 7 is a side view of the forming wheel as shown in FIG. 4.
Figure 8:
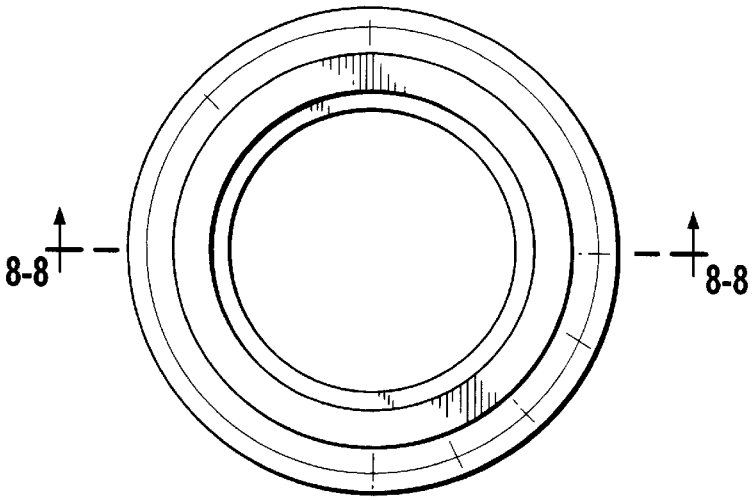
FIG. 8 is a front view of the forming wheel as shown in FIG. 4.
Figure 9:
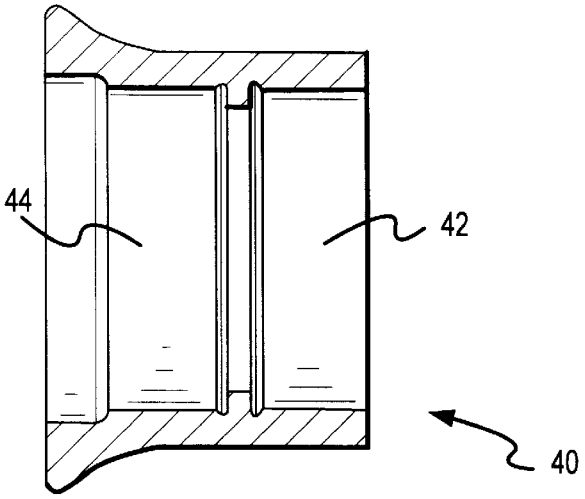
FIG. 9 is a cross section view of the forming wheel as shown in FIG. 8 as taken through the plane indicated by 8—8.
Figure 11:
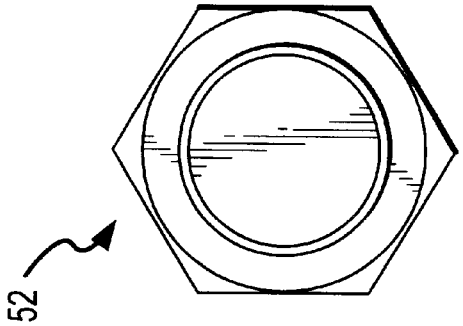
FIG. 11 is a front view of the shaft as shown in FIG. 4.
Figure 10:
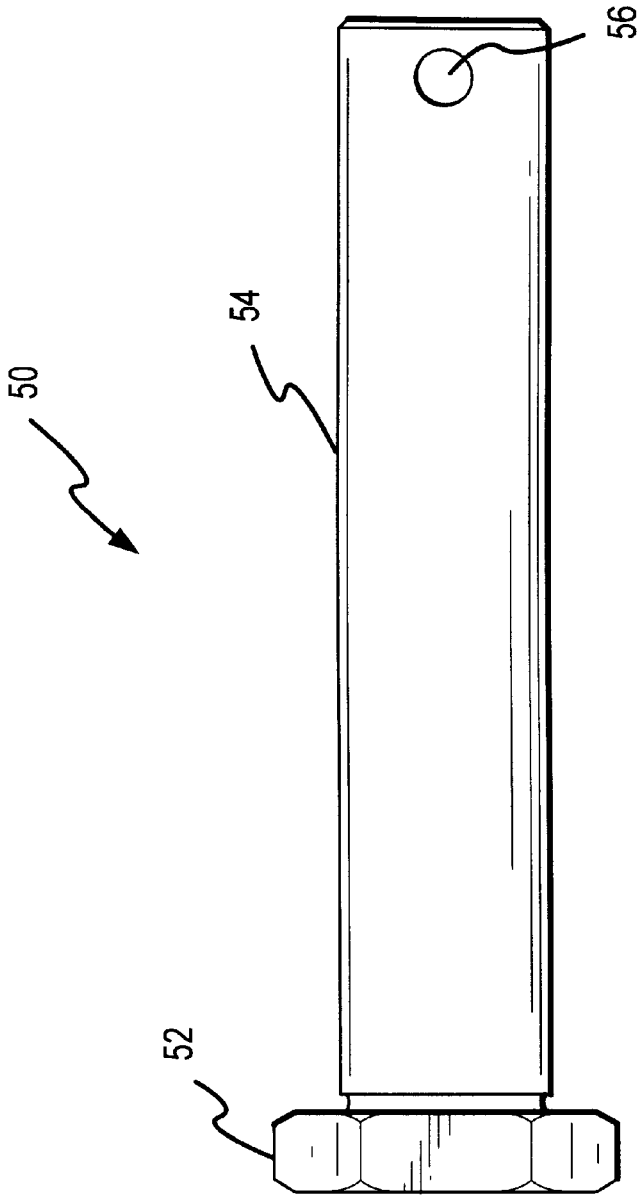
FIG. 10 is a side view of the shaft as shown in FIG. 4.
Figure 12:
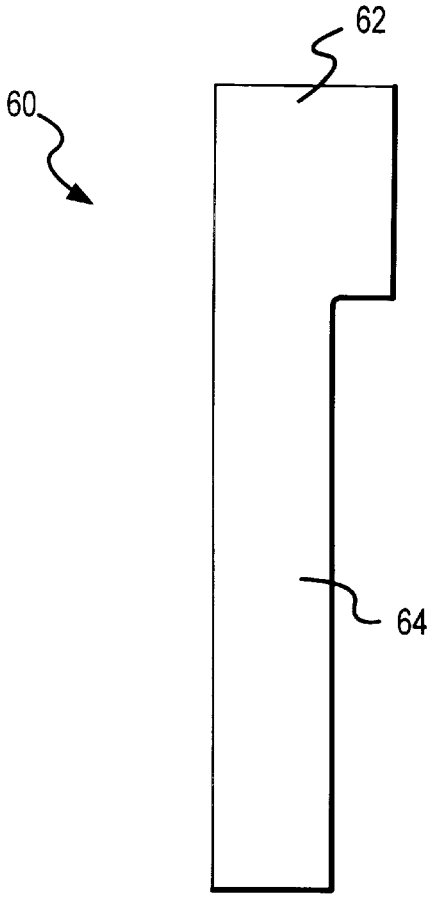
FIG. 12 is a side view of the tool holder as shown in FIG. 4.
Figure 13:
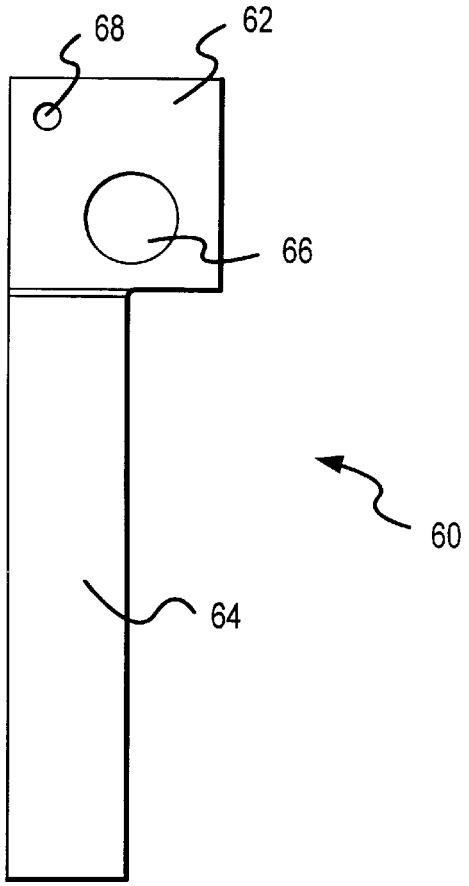
FIG. 13 is a front view of the tool holder as shown in FIG. 4.
Figure 14:
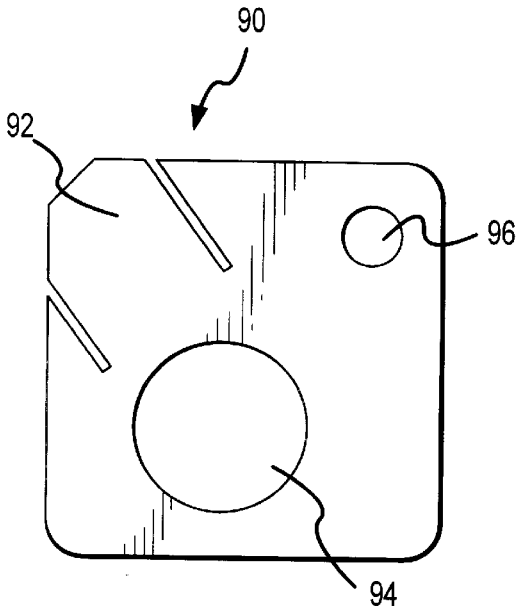
FIG. 14 is a front view of the locking plate as shown in FIG. 4.
Figure 15:
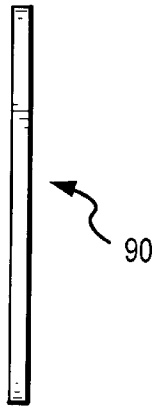
FIG. 15 is a side view of the locking plate as shown in FIG. 4.

As shown in FIGS. 4, 5 and 6, a forming tool 38 includes a forming wheel 40, a shaft 50, a tool holder 60, bearings 70, washers 80, locking plate 90, locking bolt 100, and nut 110. The bearings 70 include an inner portion 72 and an outer portion 74 which is rotatable relative to the inner portion 72, and a central opening 76. Referring to FIG. 9, the forming wheel 40 includes a first inner area 42 and a second inner area 44 in which bearings 70 are fixedly positioned. Referring to FIG. 10, the shaft 50 includes a head portion 52, a shaft portion 54 and a central opening 56 on the shaft portion 54, and a treaded end (not shown). Referring to FIGS. 12 and 13, the tool holder 60 includes a head portion 62, a shank 64, an opening 66 in the head portion 62, and a threaded opening 68 in the head portion 62. Referring to FIGS. 14 and 15, the locking plate 90 includes a tab 92, a first opening 94, and a second opening 96.

The forming tool 38 is constructed by first fixedly positioning the bearings 70 within the first inner area 42 and a second inner area 44 of the forming wheel 40 and inserting the shaft portion 54 of the shaft 50 through the central openings 76. Consequently, the inner portions 72 of the bearings 70 become fixedly attached to the shaft portion 54, and the forming wheel 40 is rotatable about the shaft portion 54. The washer 80 is next positioned on the shaft portion 54 and the shaft portion is inserted through the opening 66 of the tool holder 60. The shaft portion 54 is next inserted through the first opening 94 of the locking plate 90, and locking plate 90 is aligned with the tool holder 60 by aligning the second opening 96 of the locking plate 90 with the threaded opening 68 of the head portion 62 of the tool holder 60. A second washer 80 is next positioned on the shaft portion 54 and the nut 110 is threaded and tightened onto the threaded end (not shown) of the shaft portion 54. The locking bolt 100 is inserted through the second opening 96 of the locking plate 90 and threaded into the threaded opening 68 of the tool holder 60 and tightened. As a consequence, the forming wheel 40 is fixedly positioned relative to the tool holder 60, and is rotatable relative to the tool holder 60.

The tab 92 of the locking plate 90 is used to prohibit the nut 110 from becoming loosened. In this regard, the forming tool 38 maybe subject to torque forces which may cause the nut 110 to loosen when the forming tool 38 is used as a tool to form journals. To prevent the nut 110 from loosening after the nut 110 has been tightened, the tab 92 is bent at a 90-degree angle and aligned with one of the side walls 112 of the nut 110. Additionally, a cotter pin (not shown) is used to prevent the nut 110 from loosening after the nut 110 has been tightened. In this regard, when the tab 92 is aligned with one of the side walls 112 of the nut 110, the tabs 114 of the nut 110 are aligned with the central opening 56 of the shaft 50. The cotter pin (not shown) is inserted through the central opening 56 of the shaft 50 and attached to the shaft 50. As a result, the cotter pin contacts the tabs 114 which are aligned with the central opening 56, and thereby prevent the nut from rotating relative to the shaft 50.

The forming tool 38 is for use with a lathe (not shown) to form a journal on an extruded tube. The extruded tubing used can consist of a variety of materials having various wall thicknesses. Preferably, the portion of the extruded tube on which a journal is formed is aluminum and has a maximum wall thickness of about 0.300 inches. The forming tool 38 is used with a lathe by attaching the shank 64 of the tool holder 60 to the lathe's turret (not shown), and attaching the extruded tube 20 to the lathe's spindle (not shown).

Figure 16:
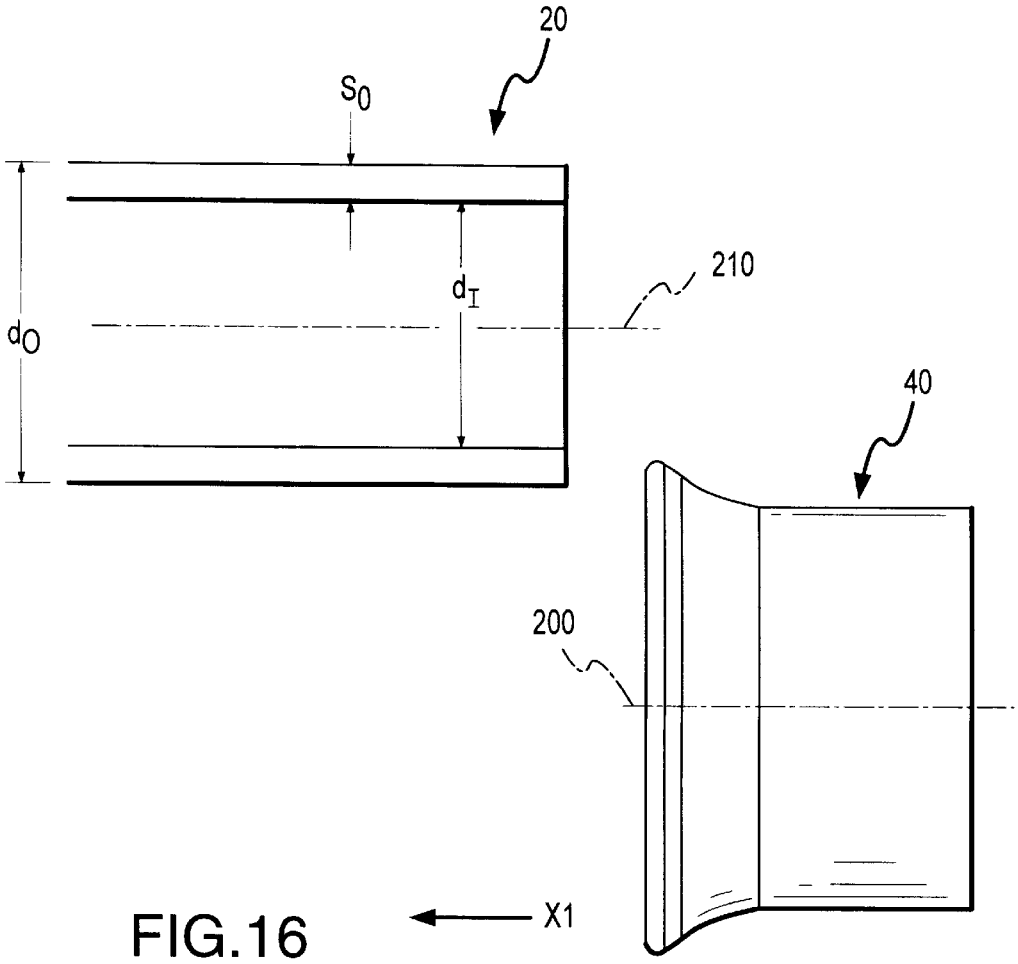
FIG. 16 shows the tool shown in FIG. 4 prior to contacting an extruded tube.
Figure 17:
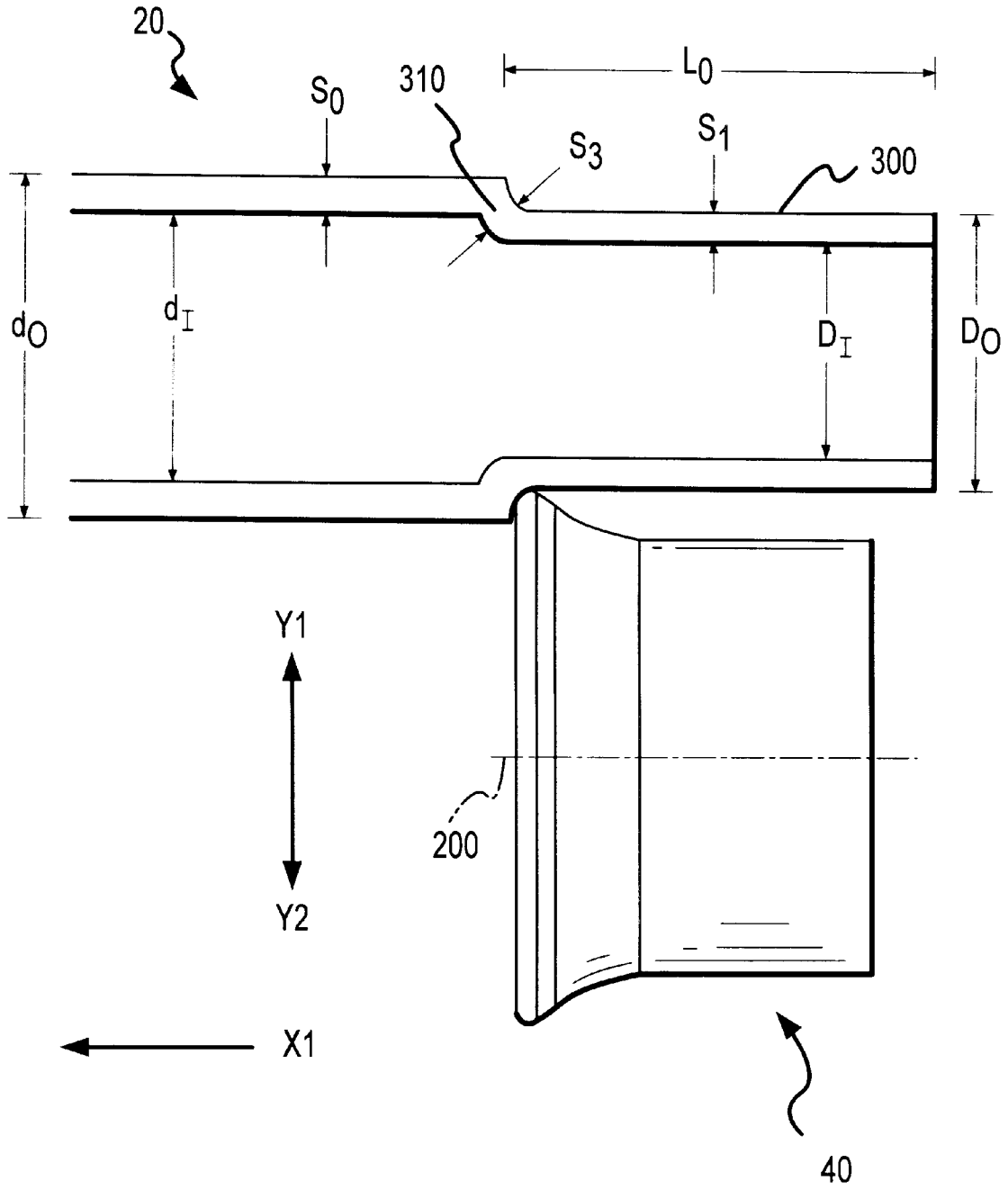
FIG. 17 shows the tool shown in FIG. 4 contacting an extruded tube on the first pass of the tool shown in FIG. 4.

Referencing FIGS. 16–19 and 23, the forming operation in accordance with the present invention occurs when the lathe's turret moves the forming tool 38 to cause the forming wheel 40 to contact the extruded tube 20, which is rotated by the lathe's spindle. FIG. 16 shows the position of the forming wheel 40 relative to the extruded tube 20 prior to the occurrence of the forming operation. As shown in FIG. 17, the forming tool 38 is moved in the direction X1 to cause the forming wheel 40 to contact the rotating extruded tube 20. As a result of the contact, the forming wheel 40 rotates about the axis 200. Preferably, the forming tool 38 is held by the turret of the lathe such that the axis 200 of rotation of the forming wheel 40 is substantially parallel to the axis 210 of rotation of the extruded tube 20. Preferably, flood coolant is used on the extruded tube during the forming operation to minimize heat generated as a result of the contact. As the forming tool 38 is moved in the direction Xl, the forming wheel 40 forms a first journal 300 on the end portion of the extruded tube 20. The first journal 300 has a wall thickness $S_1$ which is less than the starting wall thickness $S_0$ of the extruded tube 20. The first journal 300 has an inner diameter $D_I$ which is less than the starting inner diameter $d_I$, and an outer diameter $D_O$ which is less than the starting outer diameter $d_O$. In this regard, the forming tool 38 displaces material on the extruded tube 20 as the forming tool 38 is moved in the direction X1. The displaced material accumulates at the wall area 310 that interfaces the first journal 300 and the body portion of the extruded tube 20. The wall area 310 has a thickness $S_3$ which is greater than the starting wall thickness $S_0$ of the extruded tube 20.

Figure 18:
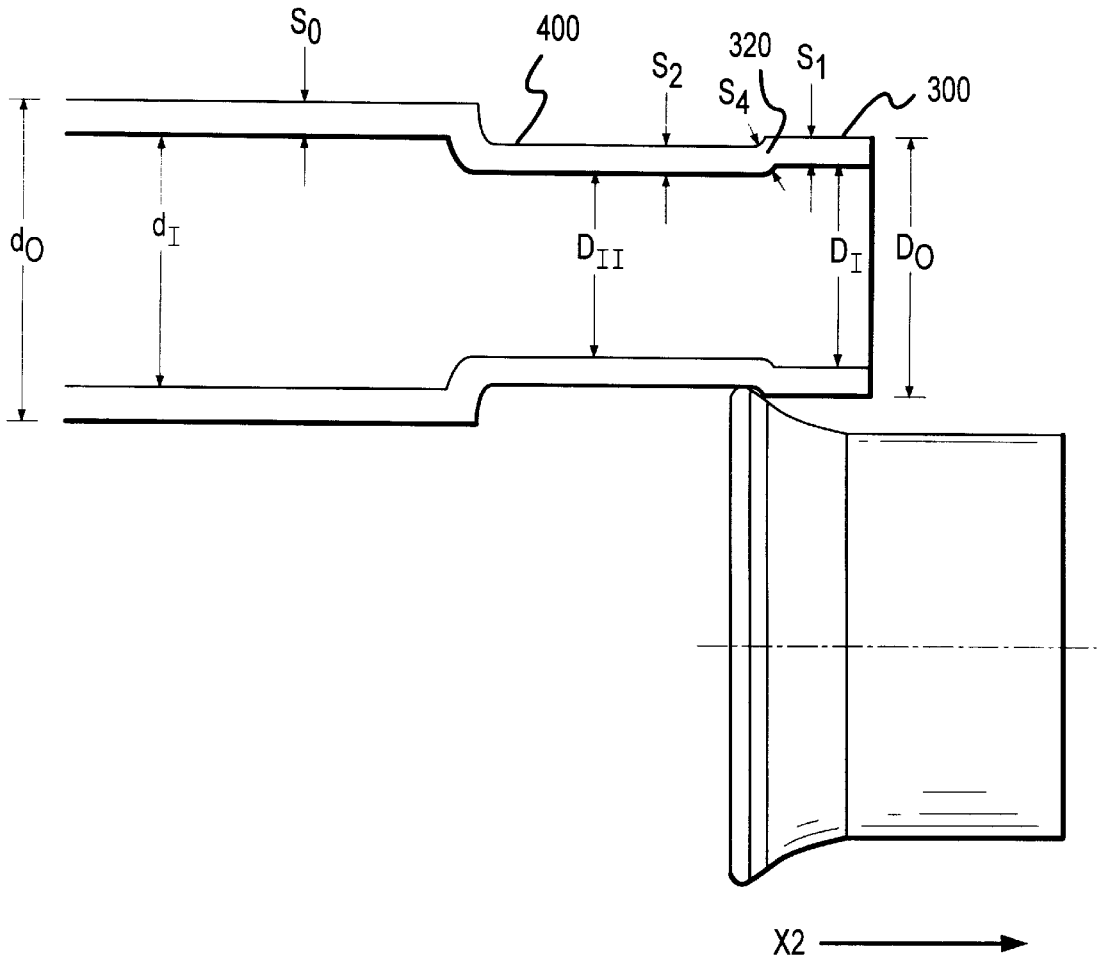
FIG. 18 shows the tool shown in FIG. 4 contacting an extruded tube on a second pass by the tool shown in FIG. 4.
Figure 19:
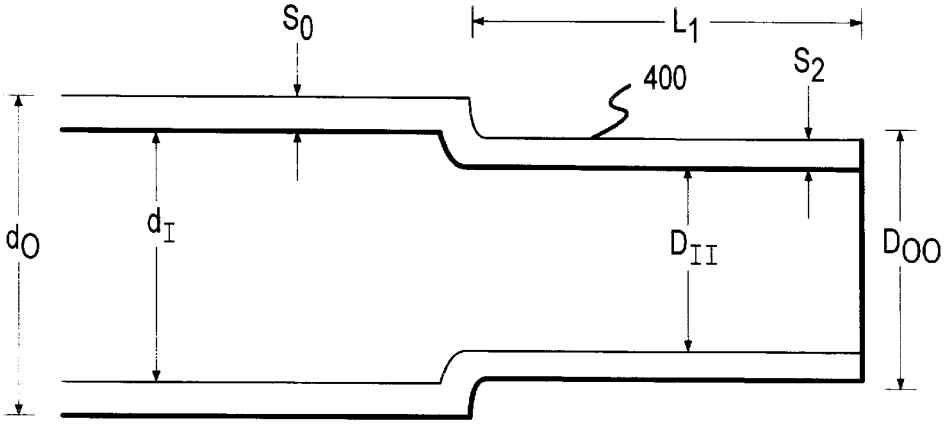
FIG. 19 shows the extruded tube after completion of the second pass by the tool shown in FIG. 4.

After the forming tool 38 has made a first pass at the extruded tube 20 to form the first journal 300, the forming tool 38 is returned to its starting position by either making a second pass at the first journal 300 or withdrawing the forming tool 38 from the extruded tube 20 and returning to the forming tool 38 to its starting position without contacting the extruded tube. In this regard, the forming tool 38 is moved in either the direction Y1 to reinitiate contact with the extruded tube 20 and moved in the direction X2 to make a second pass on the first journal 300, or the direction Y2 to withdraw the forming tool 38 from the extruded tube 20, and moved in the direction X2 to return the forming tool 38 to its starting position. If a second pass is made, the forming wheel 40 rotates about the axis 200 as a result of forming wheel 40 contacting the first journal 300 of the rotating extruded tube 20. Referencing FIGS. 18 and 19, as the forming tool 38 is moved in the direction X2, the forming wheel 40 forms a second journal 400 on the extruded tube 20, in place of the first journal 300. The journal 400 has a wall thickness $S_2$ which is less than the wall thickness $S_1$ of the first journal 300. The second journal 400 has an inner diameter $D_{II}$ which is less than the inner diameter $D_I$ of the first journal 300, and an outer diameter $D_{OO}$ which is less than the outer diameter $D_O$ of the first journal 300. In this regard, the forming tool 38 displaces material on the extruded tube 20 as the forming tool 38 moves in the direction X2. During the second pass, as shown in FIG. 18, the displaced material accumulates at the wall area 320 that interfaces the first journal 300 and the second journal 400. The wall area 320 has a thickness $S_1$, which is greater than the wall thickness $S_1$ of the first journal 300. After the second pass is completed, as is shown in FIG. 19, the displaced material is accumulated at second journal's 400 end, which results in the length $L_1$ of the second journal 400 being greater than the length $L_0$ of the first journal 300.

Figure 20:
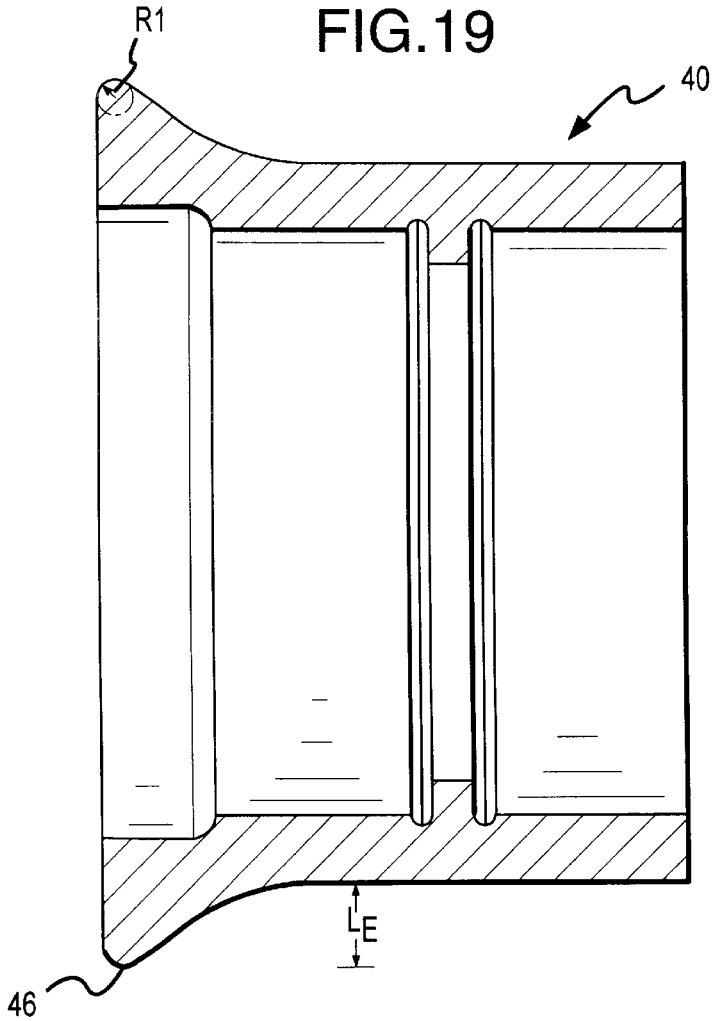
FIG. 20 shows an enlarged cross-section view of the forming wheel as shown in FIG. 8 as taken through the plane 8—8.

Referencing FIG. 20, the forming wheel 40 includes a forming edge 46, which is the portion of the forming wheel 40 that contacts the extruded tube 20 when the forming operation occurs. Referencing FIGS. 17, 18 and 20, the forming edge 46 extends a length $L_E$ from the body of the forming wheel 40 to allow the forming wheel 40 to make a pass on the extruded tube 20 when the forming wheel 40 is moved in a direction away from the spindle of the lathe, for example, the direction X2. The forming edge 46 includes a radius R1 which is varied in accordance with the amount of material desired to be displaced on the extruded tube 20, and/or the desired shape of the transition edge. In this regard, the radius R1 determines the surface area of the forming edge 46. For example, a forming wheel 40 having a forming edge 46 with a radius of 0.250 inches will have a greater surface area than a forming wheel 40 having a forming edge 46 with a radius of 0.0080 inches. The surface area of the forming edge 46 determines the amount of material which can be displaced during a single pass of a forming tool 38 during the forming operation. For example, a forming wheel 40 having a forming edge 46 with a radius of 0.250 inches is capable of displacing more material on an extruded tube 20 than a forming wheel 40 having a forming edge 46 with a radius of 0.0080 inches.

Figure 21A:
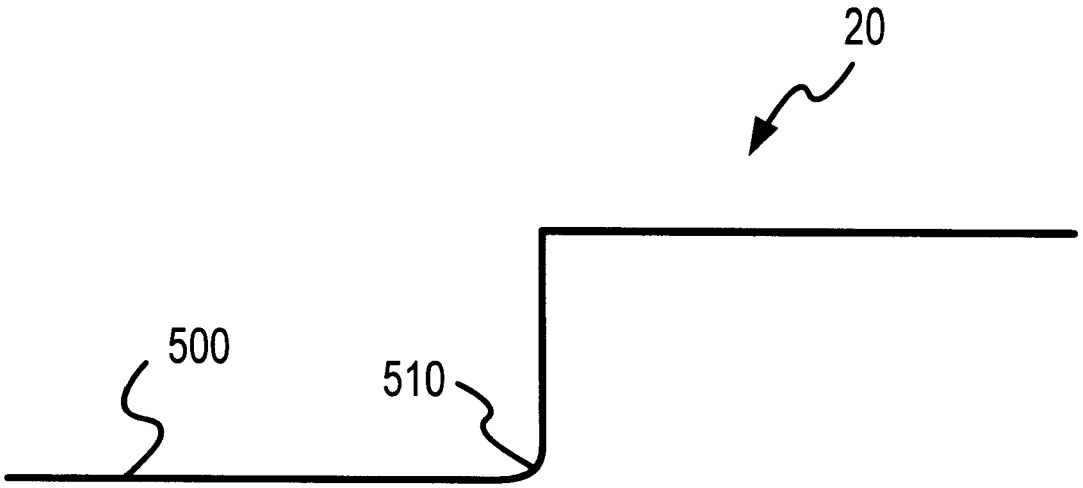
FIGS. 21A and 21B show the shapes of the transition edges of journals after using forming wheels of larger and smaller radiuses, respectively.
Figure 21B:
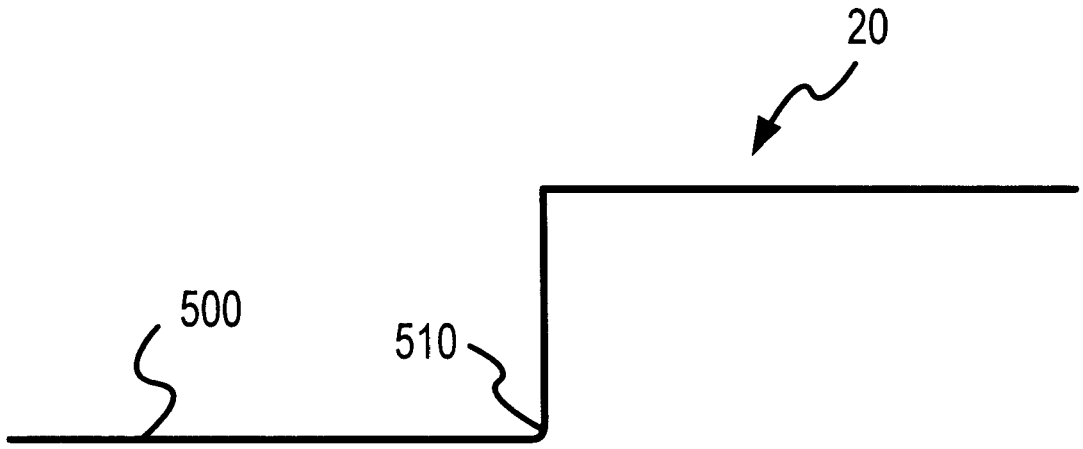
Figure 22A:
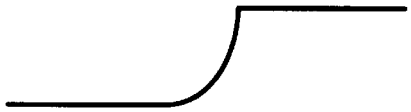
FIGS. 22A–22F show various contours of journals that can be formed by the tool shown in FIG. 4 when used with a lathe to form a journal.
Figure 22B:
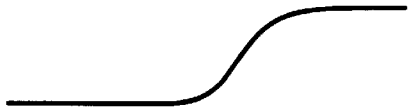
Figure 22C:
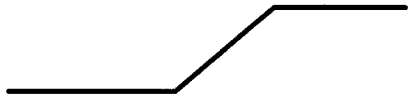
Figure 22D:
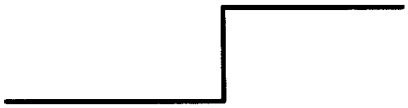
Figure 22E:
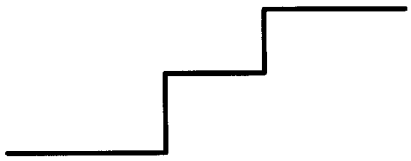
Figure 22F:
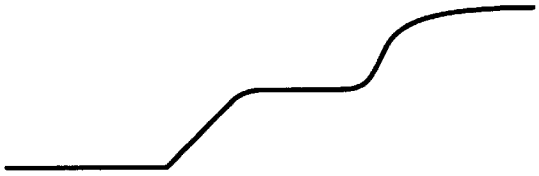
Figure 23:
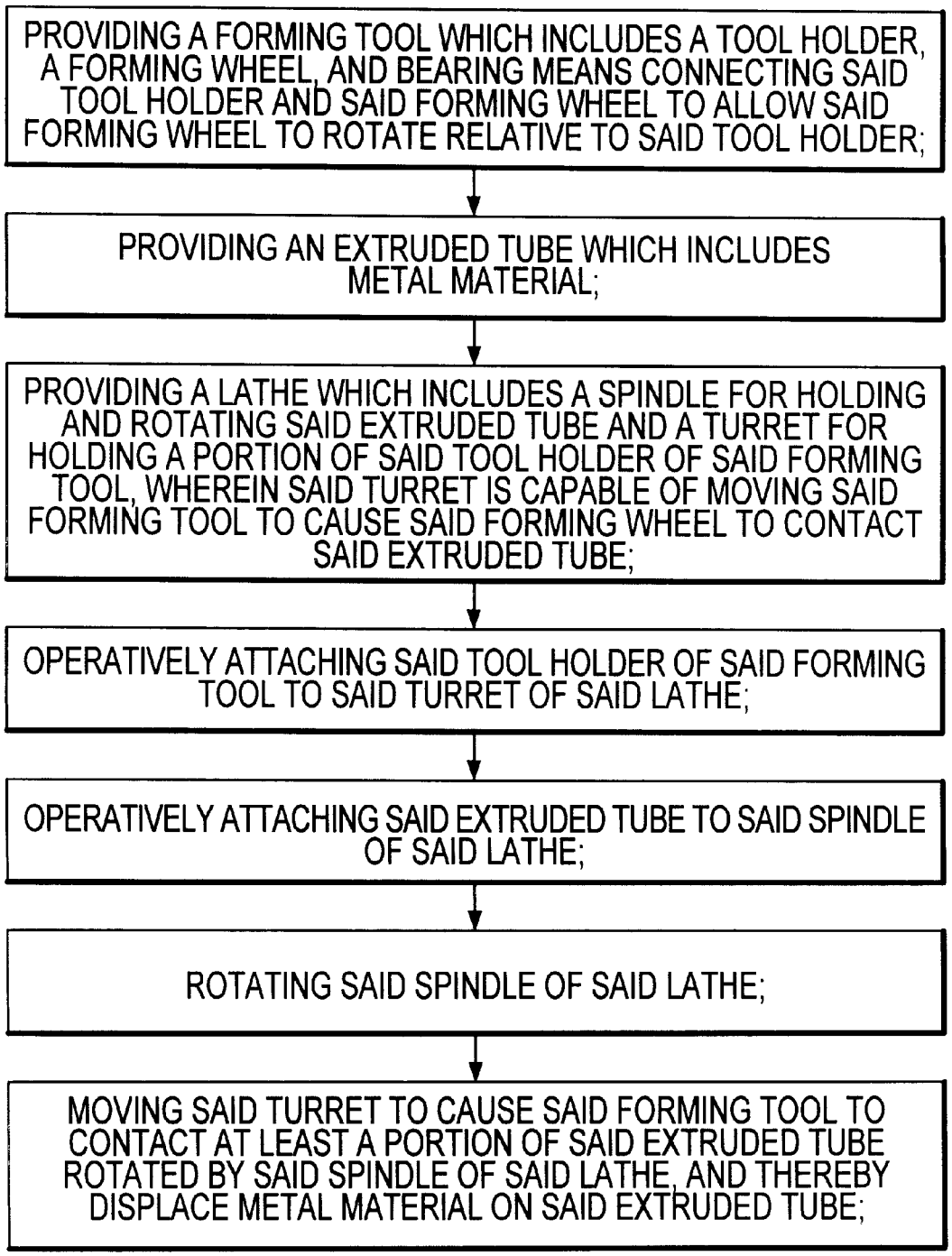
FIG. 23 is a flow diagram describing the steps for using a lathe to form a journal on an extruded tube in accordance with the present invention.

A transition edge conforming to the radius R1 of the forming wheel 40 results on the journal when the forming wheel 40 is used during the forming operation. As shown for example in FIGS. 21A, a forming wheel 40 having a forming edge 46 with a radius of 0.250 inches will result in a transition edge 510 that corresponds to a radius of 0.250 inches. As shown for example in FIGS. 21B, a forming wheel 40 having a forming edge 46 with a radius of 0.0080 inches will result in a transition edge 510 that corresponds to a radius of 0.0080 inches. Thus, depending on the amount of material to be displaced and the desired shape of the transition edge, a single forming tool is selected, or multiple forming tools having forming edges with different radiuses are selected. For example, if the sharper transition edge 510 is desired, as shown for example in FIG. 21B, a forming tool 38 having a forming wheel having a radius of R1 is selected to make a first pass on the extruded tube 20 to form the journal 500 to the desired outer diameter, and a second forming tool 38 having a radius R2, which is less than R1, is used to make a second pass on the transition edge 510 of the journal 500 to form the sharp transition edge. Preferably, the radius of the forming edge 46 is in the range of no less than 0.0080 inches and no greater than 0.250 inches.

The forming tool 38 is for use with a lathe having a variety of features. Preferably, the lathe is capable of moving the turret in variety of directions relative to the extruded tube rotated by the spindle of the lathe. More preferably, linear and/or circular interpolation is used to determine the direction of the turret relative to the extruded tube rotated by the spindle of the lathe. As a result, as shown in FIGS. 22A–22F, a variety of contours for the outer surface of the journal arc possible, including straight lines, angled lines, arcs and radiuses. Preferably, the forming tool 38 is used with a computer numerical control (CNC) lathe which is programmable to automatically move the turret in a variety of directions in accordance with one or more predefined instructions. Alternatively, a manual lathe can be used with the forming tool 38. Alternatively, the forming tool 38 is used with a lathe capable of moving the turret by the use of a hydraulic tracing unit, which is capable of causing the turret to move in accordance with a predetermined template. In this regard, the turret causes the forming tool to contact the extruded tube rotated by the spindle of the lathe and move the turret in accordance with the template being traced by the hydraulic tracing unit. Preferably, the turret of the lathe used is capable of holding multiple tools. In this regard, a larger radius forming wheel can be first utilized to displace thicker material, and a smaller radiused wheel can be next indexed as part of the same operation (i.e., not removing the extruded tube from the spindle) for forming transition edges.

What is claimed is:

1. A method for forming a journal on an extruded tube, said method comprising the steps of:

providing a forming tool which includes a tool holder, a forming wheel having a forming edge that comprises a portion of said forming wheel, and bearing means connecting said tool holder and said forming wheel to allow said forming wheel to rotate relative to said tool holder;

providing an extruded tube which includes metal material and a first end;

providing a lathe which includes a spindle capable of holding and rotating said extruded tube, wherein said spindle includes attachment means, and a turret capable of holding a portion of said tool holder of said forming tool, wherein said turret is further capable of moving said forming tool to cause said forming wheel to contact at least a portion of said extruded tube when said extruded tube is held by said spindle;

operatively attaching said tool holder of said forming tool to said turret of said lathe, operatively attaching said first end of said extruded tube to said attachment means of said spindle of said lathe, wherein said extruded tube is not internally supported, wherein said extruded tube is not held by any other part of said lathe, and wherein the portion of said extruded tube that is not held by said chuck comprises the working portion of said extruded tube;

rotating said extruded tube by causing said spindle of said lathe to rotate; and moving said turret to cause said forming edge of said forming wheel of said forming tool to contact at least a portion of said working portion of said extruded tube rotated by said spindle of said lathe, and move along a path which is substantially towards said attachment means thereby displacing metal material on said extruded tube and causing a journal to be formed.

2. The method as claimed in claim 1, further comprising the steps of:

providing a cutting tool which includes a shank, and a cutting surface, wherein said cutting surface is fixedly attached to said shank;

operatively attaching said shank of said cutting tool to said turret of said lathe; and moving said turret to cause said cutting tool to contact at least a portion of said working portion of said extruded tube rotated by said spindle of said lathe, and thereby remove metal material from said extruded tube.

3. The method as claimed in claim 2, wherein said step of moving said turret to cause said forming tool to displace material on said extruded tube occurs before said step of moving said turret to cause said cutting tool to remove material from said extruded tube.

4. The method as claimed in claim 1, wherein said lathe is programmable to automatically move said turret in accordance with one or more predefined instructions;

wherein said step of moving said turret to cause said forming edge to contact said working portion of said extruded tube rotated by said spindle of said lathe occurs automatically in accordance with said predefined instructions.

5. The method as claimed in claim 1, wherein said step of moving said turret to cause said forming tool to contact said working portion of said extruded tube rotated by said spindle of said lathe occurs manually.

6. The method as claimed in claim 1, further comprising the steps of:

providing a hydraulic tracing unit operatively connected to said turret of said lathe to cause said turret to move in accordance with a predetermined template;

wherein said step of moving said turret to cause said forming tool to contact said working portion of said extruded tube rotated by said spindle of said lathe occurs in accordance with the template being traced by said hydraulic tracing unit.

7. The method as claimed in claim 1, further comprising the step of providing flood coolant on said extruded tube when said forming wheel contacts with said working portion of said extruded tube.

8. The method as claimed in claim 1, wherein said forming wheel includes:

a first end and a second end opposite said first end;

wherein said forming edge is at said first end.

9. The method as claimed in claim 1, wherein the outer edge of said forming edge comprises a circular cross sectional shape having a first radius;

wherein said first radius is no less than about 0.080 inches and no greater than about 0.250 inches.

10. The method of claim 1 wherein said extruded tube is aluminum.

11. The method of claim 1, wherein said spindle rotates said extruded tube about a first axis;

wherein said forming wheel rotates about a second axis, parallel to said first axis, when said forming edge contacts said extruded tube.

12. The method of claim 1, wherein said a lathe includes a motor means for rotating said extruded tube;

wherein the horse power of said motor means is no less than about 5 and no greater than about 20.

13. The method of claim 1, wherein said attachment means is selected from the group consisting of a chuck and a collet.

14. A method for forming a journal on an extruded tube, said method comprising the steps of:

providing a first forming tool which includes a tool holder, a forming wheel having a forming edge that comprises a portion of said forming wheel, and bearing means connecting said tool holder and said forming wheel to allow said forming wheel to rotate relative to said tool holder;

providing a second forming tool which includes a tool holder, a forming wheel having a forming edge that comprises a portion of said forming wheel, and bearing means connecting said tool holder and said forming wheel to allow said forming wheel to rotate relative to said tool holder;

providing an extruded tube which includes metal material, an inner surface area and an outer surface area;

providing a lathe which includes a spindle for holding and rotating said extruded tube and a turret for holding a portion of said tool holder of said first forming tool and a portion of said tool holder of said second forming tool, wherein said turret is capable of moving either of said first forming tool to cause said forming wheel of said first forming tool to contact said extruded tube when said extruded tube is held by said spindle;

operatively attaching a portion of said tool holder of said first forming tool to said turret of said lathe;

operatively attaching said tool holder of said second forming tool to said turret of said lathe;

operatively attaching said extruded tube to said spindle of said lathe, such that said inner surface area of said extruded tube is not supported and wherein said extruded tube is not held by any other part of said lathe;

rotating said extruded tube by causing said spindle of said lathe to rotate;

moving said turret in a direction substantially towards said spindle to cause said forming edge of said first forming tool to contact at least a portion of said outer surface area of said extruded tube rotated by said spindle of said lathe, thereby displacing metal material on said extruded tube and causing a journal to be formed; and moving said turret to cause said forming edge of said second forming tool to contact at least a portion of said outer surface of said extruded tube rotated by said spindle of said lathe, thereby displacing metal material on said extruded tube.

15. A method for forming and finishing a journal on an extruded tube, said method comprising the steps of:

providing a forming tool which includes a tool holder, a forming wheel having a forming edge that comprises a portion of said forming wheel, and bearing means connecting said tool holder and said forming wheel to allow said forming wheel to rotate relative to said tool holder;

providing a cutting tool which includes a shank, and a cutting surface, wherein said cutting surface is fixedly attached to said shank;

providing an extruded tube which includes metal material and a first end;

providing a lathe which includes a spindle capable of holding and rotating said extruded tube, wherein said spindle includes a chuck, and a turret capable of holding a portion of said tool holder of said forming tool and the shank of said cutting tool, wherein said turret is further capable of moving either of said forming tool to cause said forming wheel of said forming tool to contact at least a portion of said extruded tube or said cutting tool to cause said cutting surface to contact at least a portion of said extruded tube;

operatively attaching said tool holder of said forming tool to said turret of said lathe;

operatively attaching said shank of said cutting tool to said turret of said lathe;

operatively attaching said first end of said extruded tube to said chuck of said spindle of said lathe, wherein said extruded tube is not internally supported, wherein said extruded tube is not held by any other part of said lathe, and wherein the portion of said extruded tube that is not held by said chuck comprises the working portion of said extruded tube;

rotating said extruded tube about a first axis by causing said spindle of said lathe to rotate;

moving said turret in a direction substantially towards said spindle to cause said forming edge of said forming tool to contact at least a portion of said working portion of said extruded tube rotated by said spindle of said lathe, thereby displacing metal material on said extruded tube and causing a journal to be formed; and moving said turret to cause said cutting tool to contact at least a portion of the journal formed on said extruded tube rotated by said spindle of said lathe, thereby cutting metal material from said extruded tube and causing said journal to be finished.

16. A method for forming a journal on an extruded tube, said method comprising the steps of:

providing a forming tool which includes a tool holder, a forming wheel having a forming edge consisting of a circular cross sectional shape having a radius of no less than about 0.080 inches and no greater than about 0.250 inches and bearing means connecting said toolholder and said forming wheel to allow said forming wheel to rotate relative to said toolholder;

providing an extruded tube which includes metal material, an inner surface area and an outer surface area;

providing a lathe which includes a spindle for holding and rotating said extruded tube and a turret for holding a portion of said toolholder of said forming tool;

operatively attaching a portion of said forming tool to said turret of said lathel operatively attaching said extruded tube to said spindle of said lathe, such that said inner surface area of said extruded tube is not supported;

rotating said extruded tube by causing said spindle of said lathe to rotate;

moving said turret in a direction substantially toward said spindle to cause said forming edge of said forming tool to contact at least a portion of said outer surface area of said extruded tube rotated by said spindle of said lathe.

17. A method for forming a journal on an extruded tube, said method comprising the steps of:

providing a forming tool which includes a tool holder, a forming wheel fixedly attached to said tool holder, said forming wheel having a forming edge that comprises a portion of said forming wheel;

providing an extruded tube which includes metal material and a first end;

providing a lathe which includes a spindle capable of holding and rotating said extruded tube, wherein said spindle includes attachment means, and a turret capable of holding a portion of said tool holder of said forming tool, wherein said turret is further capable of moving said forming tool to cause said forming wheel to contact at least a portion of said extruded tube when said extruded tube is held by said spindle;

operatively attaching said tool holder of said forming tool to said turret of said lathe;

operatively attaching said first end of said extruded tube to said attachment means of said spindle of said lathe, wherein said extruded tube is not internally supported, wherein said extruded tube is not held by any other part of said lathe, and wherein the portion of said extruded tube that is not held by said chuck comprises the working portion of said extruded tube;

rotating said extruded tube by causing said spindle of said lathe to rotate; and moving said turret to cause said forming edge of said forming wheel of said forming tool to contact at least a portion of said working portion of said extruded tube rotated by said spindle of said lathe, and move along a path which is substantially towards said attachment means thereby displacing metal material on said extruded tube and causing a journal to be formed.

* * * * *